US007285023B1

(12) United States Patent
Chang et al.

(10) Patent No.: US 7,285,023 B1
(45) Date of Patent: Oct. 23, 2007

(54) EXPRESSCARD DEVICE

(75) Inventors: Chi-Tung Chang, Taipei (TW); Chi-Lei Kao, Taipei (TW); Shih-Min Lan, Taipei (TW)

(73) Assignee: Alcor Micro, Corp., Taipei (TW)

( * ) Notice: Subject to any disclaimer, the term of this patent is extended or adjusted under 35 U.S.C. 154(b) by 0 days.

(21) Appl. No.: 11/714,795

(22) Filed: Mar. 7, 2007

(30) Foreign Application Priority Data

Jan. 8, 2007 (TW) ..... 96100701 A

(51) Int. Cl.
*H01R 25/00* (2006.01)

(52) U.S. Cl. ..... 439/638; 439/945

(58) Field of Classification Search ..... 439/76.1, 439/638, 945
See application file for complete search history.

(56) References Cited

U.S. PATENT DOCUMENTS 6,361,372 B1 * 3/2002 Chiang ..... 439/680
6,524,137 B1 * 2/2003 Liu et al. ..... 439/638
6,879,597 B2 * 4/2005 Tordera et al. ..... 370/463
6,890,188 B1 * 5/2005 Le ..... 439/76.1

FOREIGN PATENT DOCUMENTS

TW M255969 1/2005
TW M277043 10/2005

* cited by examiner

*Primary Examiner*—James Harvey
(74) *Attorney, Agent, or Firm*—Rosenberg, Klein & Lee

(57) ABSTRACT

An ExpressCard device is applied to a computer system, and comprises a USB connector, an ExpressCard interface connector, and a control unit. The USB connector is used to connect with a USB interface provided by the computer system, the ExpressCard interface connector is used to connect with an ExpressCard interface provided by the computer system, and the control unit is used to transmit data to the computer system via either the ExpressCard interface connector or the USB connector at the same time. The ExpressCard interface connector is based on the USB standard so that the ExpressCard interface connector or the USB connector is connected with the control unit via a same USB signal pin. Thereby, the present invention allows a single ExpressCard device without an adapter to be applied to the computer system with different connection interfaces.

10 Claims, 6 Drawing Sheets

EXPRESSCARD DEVICE

BACKGROUND OF THE INVENTION

1. Field of the Invention

The invention relates to an ExpressCard device, and more particularly to an ExpressCard device with a USB connector.

2. Description of the Prior Art

Recently with the rapid development of technologies, lighter, more flexible and more stable ExpressCard transmission interface standards have been developed to gradually replace original PCMCIAs or CardBus interfaces supported by notebook computers.

There are two kinds of underlying transmission techniques for the transmission standards of ExpressCards—the PCI Express standard and the USB standard. For hardware architecture, the ExpressCard transmission interface is directly connected with chip sets of the motherboard to support hot-swapping technology without bridge chips.

In generally, the ExpressCard interface is mostly applied to notebook computers. Hence, ExpressCard devices supported by the ExpressCard interface of notebook computers can be conveniently used. However, ExpressCard devices are not supported by most desktop computers or other kinds of computers thereby limiting the supportability and purpose of ExpressCard devices.

Please refer to FIG. 1 which is a schematic view of adapting an ExpressCard device to an adapter according to the prior art. The adapter 11' is connected with the ExpressCard device 1' for transforming an ExpressCard interface 10' into a common USB interface 111' so that a computer system is provided with two different interfaces. For example, TW Patent M255969 published on Jan. 21, 2005, and TW Patent M277043 published on Oct. 1, 2005 both disclose that the ExpressCard device 1' can be connected with different transmission interfaces via the adapter 11'.

Please refer again to FIG. 1 which is a schematic view of the ExpressCard device plugging into a computer system according to the prior art. An extended adapter 210' (such as a PCI interface, a PCI-E interface, etc.) is disposed on a mother board 2' of the computer system so that the computer system is provided with an ExpressCard interface slot 211' to connect the ExpressCard device 1' via the extended adapter 210'.

However, the disadvantage of the prior art is that users have to purchase other devices for adapting to the computer system thereby increasing costs and decreasing convenience and portability.

The inventor of the present invention recognizes the above shortage should be improved and special effort has been made to research this field. The present invention is presented with reasonable design to resolve the above problems.

SUMMARY OF THE INVENTION

The primary object of the present invention is to provide an ExpressCard device that further provides a USB connector and correctly transmits data to a computer system via any connector by designing a simple hardware circuit so that users only operate an ExpressCard device to conveniently connect with a computer system having different connection interfaces without adapting.

To achieve the object stated above, an ExpressCard device is applied to a computer system. The ExpressCard device comprises a USB connector, an ExpressCard interface connector, and a control unit. The USB connector is used to connect with a USB interface provided by the computer system, the ExpressCard interface connector is used to connect with an ExpressCard interface provided by the computer system, and the control unit is used to simultaneously transmit data to the computer system via either the ExpressCard interface connector or the USB connector. The ExpressCard interface connector is based on the USB standard so that the ExpressCard interface connector or the USB connector is connected with the control unit via a same USB signal pin.

Thereby, the ExpressCard device is not only connected with the ExpressCard connection interface of the computer system via the ExpressCard interface connector to transmit data, but is also connected with the USB connection interface of the computer system via the USB connector without the ExpressCard connection interface so as to transmit USB signals via a single device with two different connection interfaces.

It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF THE DRAWINGS

The above and further advantages of this invention may be better understood by referring to the following description, taken in conjunction with the accompanying drawings, in which.

The drawings will be described further in connection with the following detailed description of the present invention.

DETAILED DESCRIPTION OF THE PREFERRED EMBODIMENTS

Figure 1:
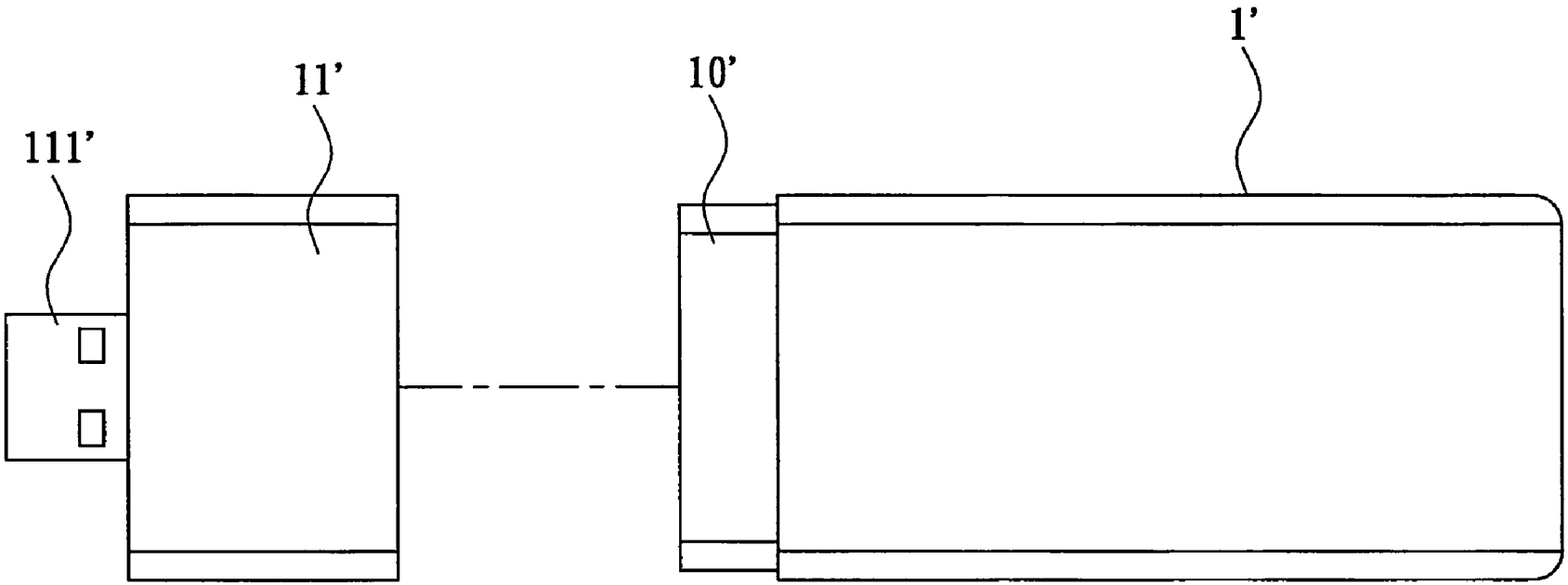
FIG. 1 PRIOR ART
FIG. 1 is a schematic view of adapting an ExpressCard device to an adapter according to the prior art.
Figure 2:
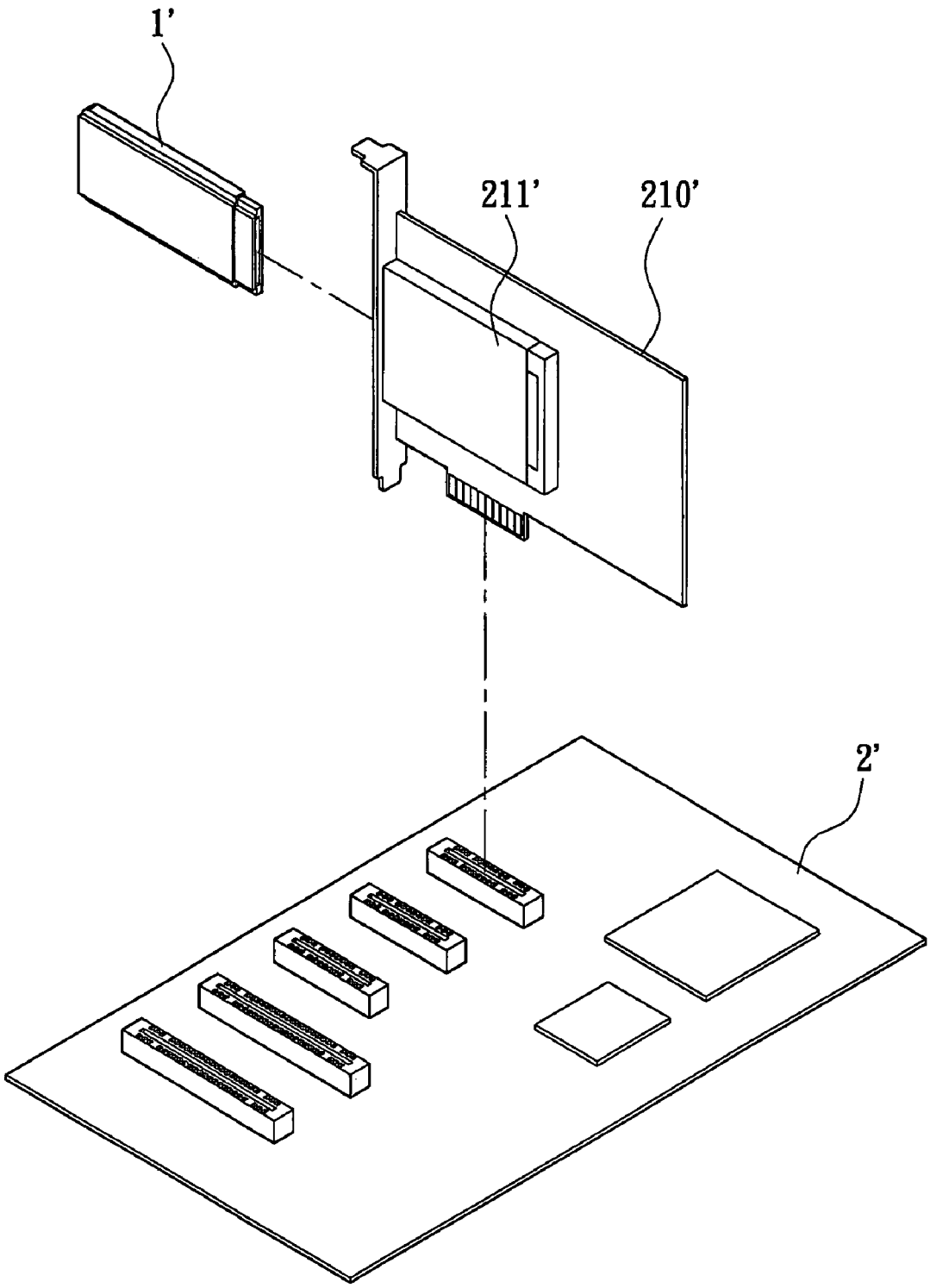
FIG. 2 PRIOR ART
FIG. 2 is a schematic view of plugging the ExpressCard device into a computer system according to the prior art.
Figure 3:
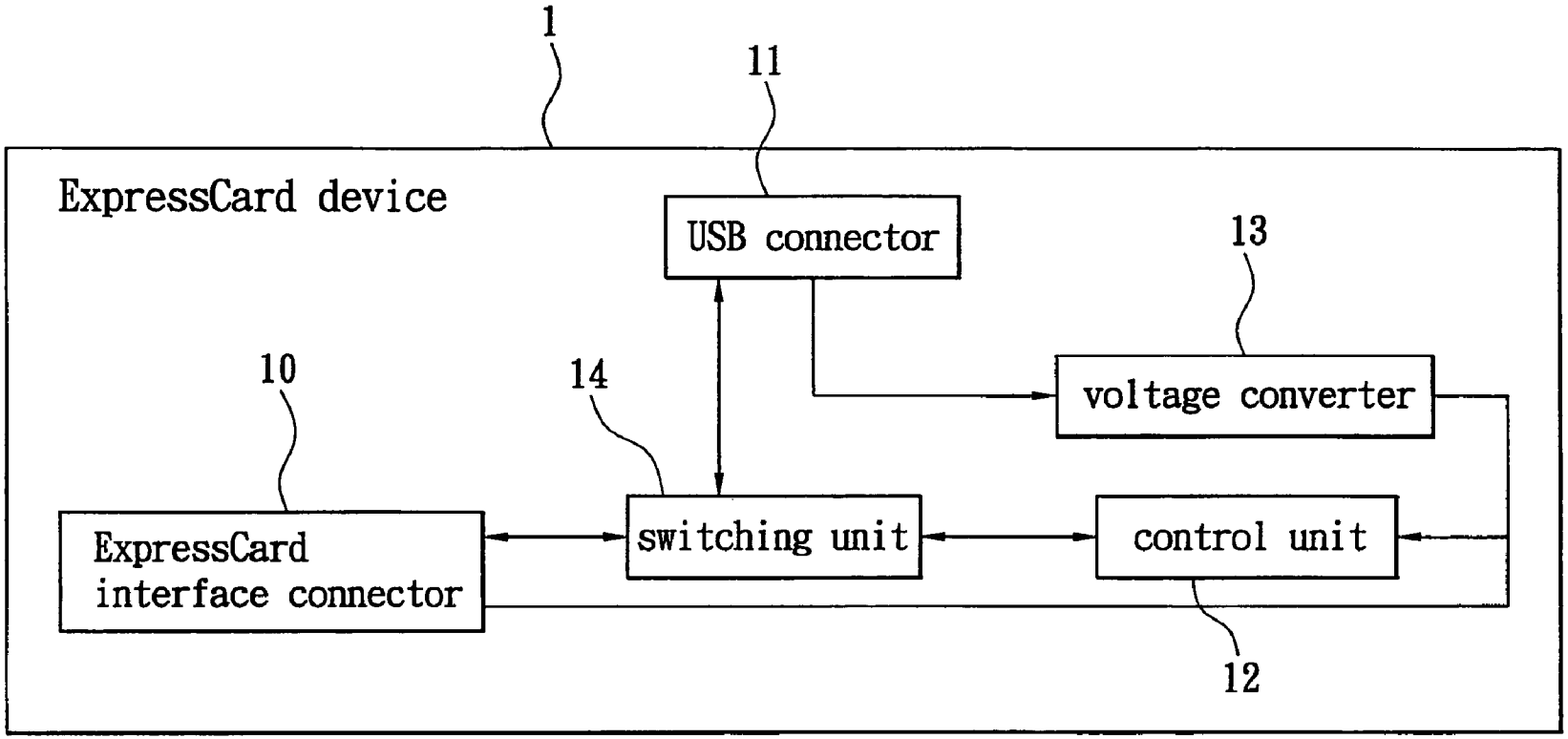
FIG. 3 is a block diagram of a preferred embodiment of an ExpressCard device according to the present invention.

Please refer to FIG. 3 which is a block diagram of a preferred embodiment of an ExpressCard device according to the present invention. An ExpressCard device 1 comprises an ExpressCard interface connector 10, a USB connector 11, and a control unit 12. The ExpressCard device 1 is not only connected with an ExpressCard interface 211 of a computer system 2, such as a notebook computer, via the ExpressCard interface connector 10, but is also connected with a USB interface 212 of the computer system 2 via the USB connector 11 so that the ExpressCard device 1 can be connected with the computer system 2 with different kinds of interfaces via two different kinds of connectors. The USB interface 212 is provided by the computer system 2 is USB-Type-A or USB-Type-B standard.

The ExpressCard device 1 of the present invention can be a storage device or a transmission device. The storage device is a memory card reader or a pen drive, and the transmission device is a wireless transceiver for infrared, Bluetooth, Internet, or digital television. Hence, the control unit 12 can further connect to memory card connector or a flash memory (not shown) as a memory card reader or a pen drive, or a wireless transceiver element (not shown) as a wireless transmission device.

The control unit 12 of the ExpressCard device 1 is used to transmit data to the computer system 2 via the ExpressCard interface connector 10 or the USB connector 11. In order that the control unit 12 is adapted to the two connector interfaces, the control unit 12 is a control chip of USB standard. In addition, the ExpressCard interface 211 of the computer system 2 uses a USB standard as an underlying transmission technique so that the ExpressCard interface connector 10 and the USB connector 11 can be connected with the control unit 12 via a same USB signal pin (D+ and D−). Further, a switching unit 14 is connected between the ExpressCard interface connector 10 and the USB connector 11 to prevent affecting quality and accuracy of the transmitted data due to interference of the USB signal. The switching unit 14 is used to switch the ExpressCard interface connector 10 and the USB connector 11 according to a priority value so that only one of the two connectors are connected with the computer system 2 at the same time. The priority value is determined is that either the ExpressCard interface connector 10 or the USB connector 11 first connected with the computer system 2 obtain the priority value. Hence, it ensures that the USB signal transmitted can't be affected due to the other connector making a mistake in connection when one connector has already connected with the computer system 2.

In this embodiment, an operating voltage of the control unit 12 of 3.3 volts is taken as an example. For the USB standard, a first voltage provided by the computer system 2 via the USB interface 212 is 5 volts. Because the 5-volt first voltage does not match the operating voltage (3.3 volts) of the control unit 12, the first voltage has to be transformed into the desired operating voltage (3.3 volts) by a voltage converter 13 connected between the USB connector 11 and the control unit 12. For the ExpressCard standard, a second voltage provided to the ExpressCard device 1 by the computer system 2 via the ExpressCard interface 211 is 3.3 volts. Hence, the second voltage received by the ExpressCard interface connector 10 can be directly outputted and supplied to the control unit 12. That is to say, when the ExpressCard device 1 is connected with the computer system via the ExpressCard interface connector 10, the second voltage provided by the computer system 2 can be directly received as the desired operating voltage for the control unit 12 via the ExpressCard interface connector 10. In addition, when the ExpressCard device 1 is connected with the computer system 2 via the USB connector 11, the first voltage provided by the computer system 2 has to be transformed into the desired operating voltage for the control unit 12 by the voltage converter 13.

The above-mentioned operating voltage of the control unit 12 supports not only 3.3-volt control chips but also 5-volt control chips, or supports both the 3.3-volt control chips and the 5-volt control chips at the same time. Because of the different operating voltages of the control unit 12, the voltage can be connected with the USB connector 11 and/or the ExpressCard interface connector 10 according to the desired operating voltage of the control unit 12 so that the control unit 12 can use the 5-volt first voltage transmitted via the USB connector 11 and the 3.3-volt second voltage transmitted via the ExpressCard interface connector 10 by voltage transformation of the voltage converter 13.

For design of the ExpressCard device 1, the first voltage received by the USB connector 11 and the second voltage received by the ExpressCard interface connector 10 are both provided to same voltage pins of the control unit 12. In order to avoid one connector being damaged only one connector of the ExpressCard device 1 can be connected with the computer system at the same time. Hence, the ExpressCard device 1 further has a first special diode and a second special diode (not shown) separately and electrically connected with the ExpressCard interface connector 10 and the USB connector 11 for limiting direction of currents separately produced by the first voltage and the second voltage so that only a forward current turns on one of the special diodes. Furthermore, the first special diode and the second special diode can be further connected in parallel with metal oxide semiconductor field effect transistors, MOSFETs (not shown) to drop a voltage from about 0.5 to 0.7 volts so that the control unit 12 passes a limitation of the USB standard during an initiation procedure. The first special diode and the second special diode can be Schottky Diodes.

Figure 4:
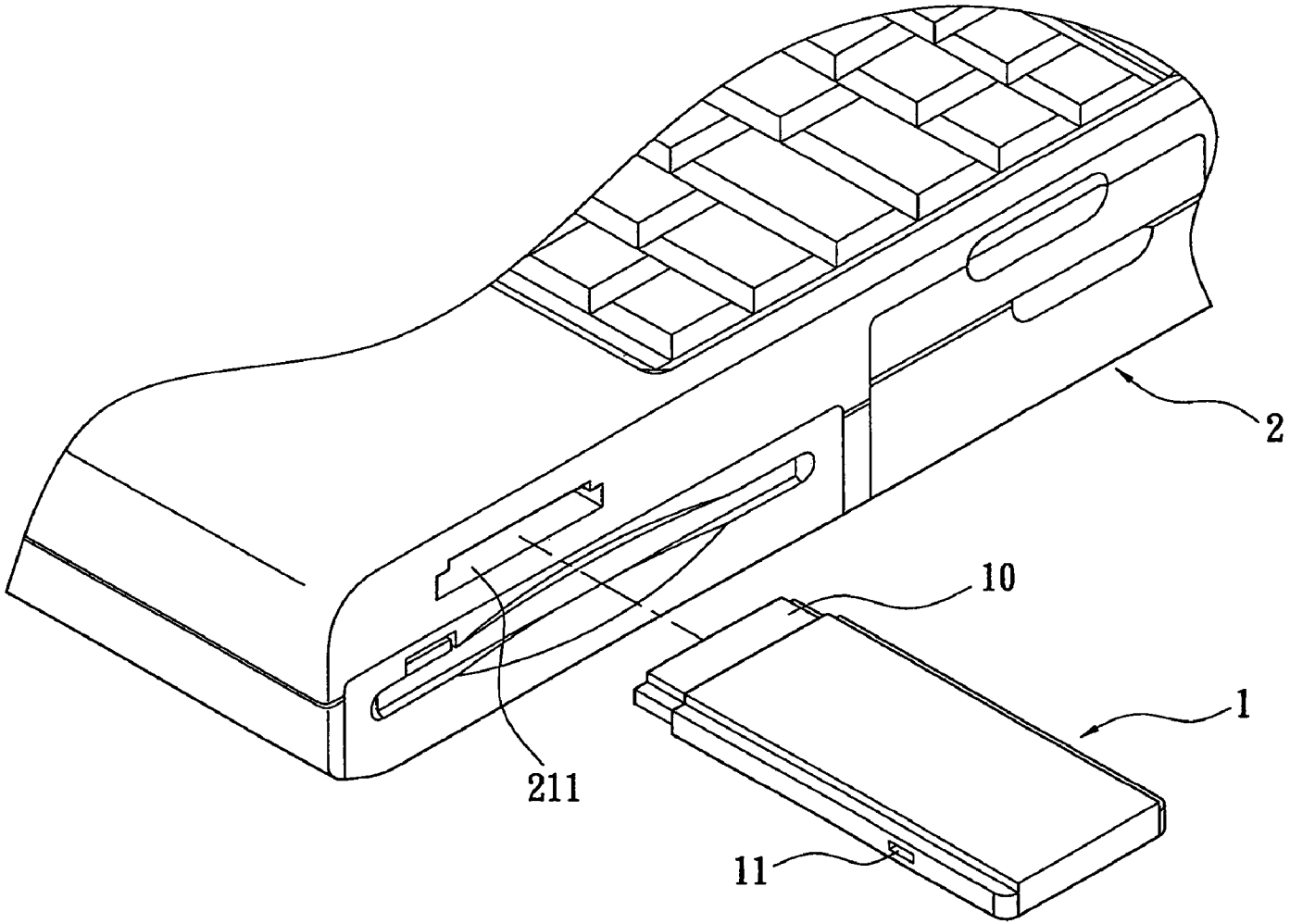
FIG. 4 is a schematic view of a first embodiment of the ExpressCard device according to the present invention.

Please refer to FIG. 4 which is a schematic view of a first embodiment of the ExpressCard device according to the present invention. In this embodiment, a notebook computer is taken as the computer system 2 for example. The ExpressCard device 1 can be connected with the ExpressCard interface 211 provided by the computer system 2 via the ExpressCard interface connector 10 so as to transmit data between the ExpressCard device 1 and the computer system 2. Meanwhile, the USB connector 11 of the ExpressCard device 1 is not connected.

Figure 5A:
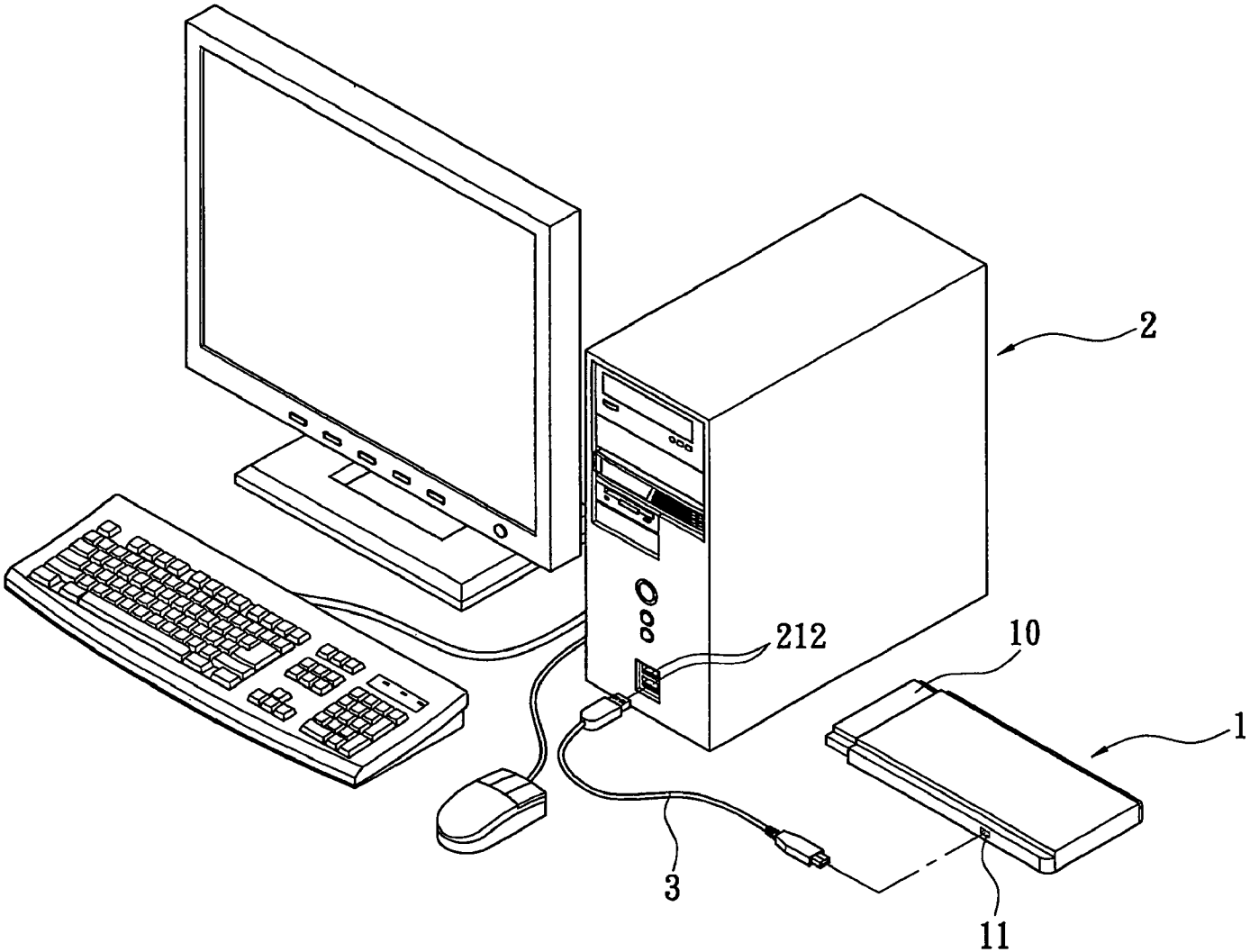
FIG. 5A is a schematic view of a connection of a second embodiment of the ExpressCard device according to the present invention.

Please refer to FIG. 5A which is a schematic view of a connection of a second embodiment of the ExpressCard device according to the present invention. In this embodiment, a desktop computer is taken as the example of the computer system 2. In generally, the desktop computer provides only the USB interface 212 and not the ExpressCard interface 211. Hence, the ExpressCard device 1 can still transmit data to the computer system 2 via the USB connector 11 connected with the USB interface 212 of the computer system 2. In addition, the USB connector 11 is connected with the USB interface 212 via a USB plug 3, and a separable USB plug is taken as an example in this embodiment.

Figure 5B:
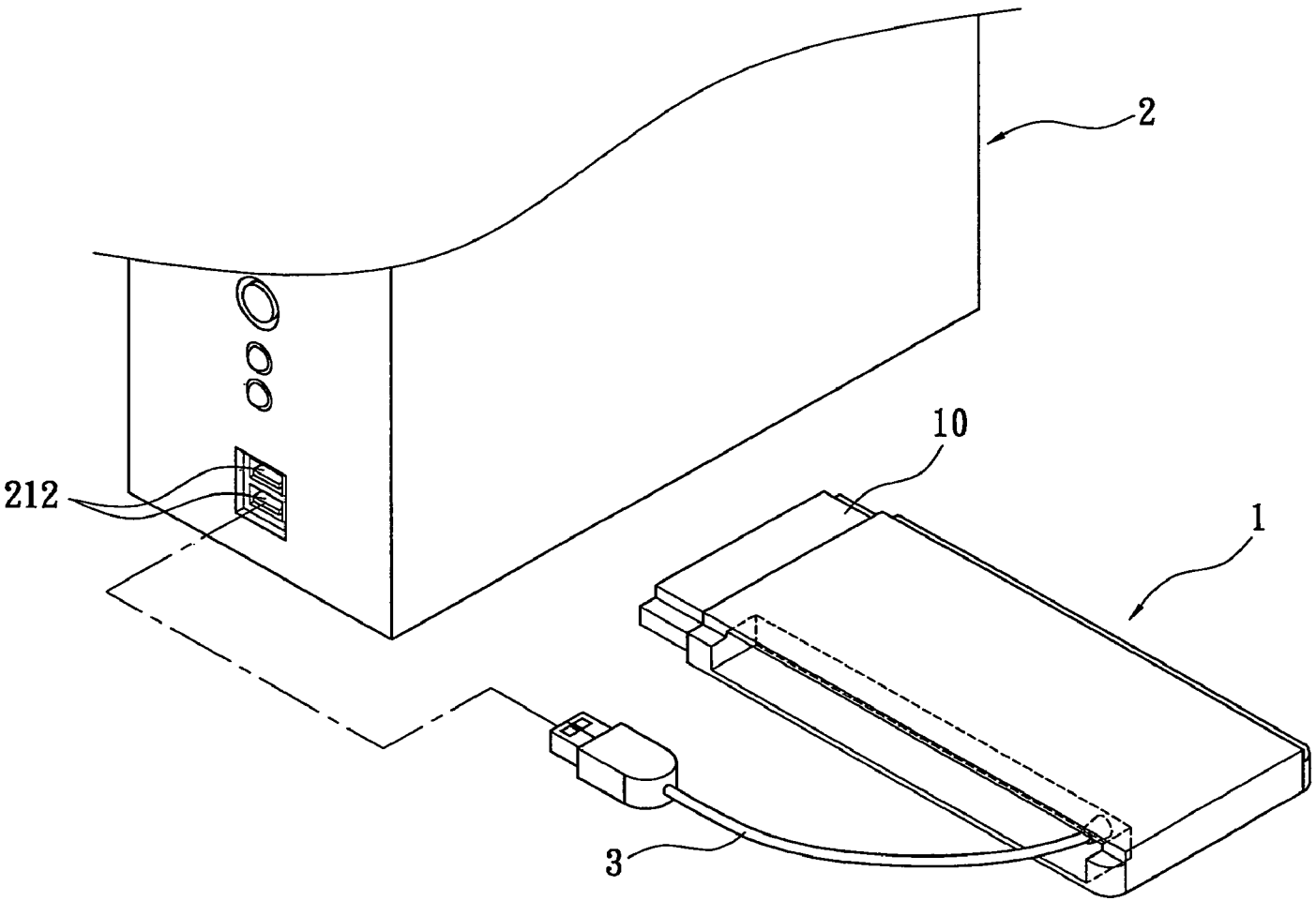
FIG. 5B is a schematic view of another connection of the second embodiment of the ExpressCard device according to the present invention.

However, types and connection ways of the USB plug 3 are not limited to these embodiments. Please refer to FIG. 5B which is a schematic view of a connection of a second embodiment of the ExpressCard device according to the present invention. The descriptions of FIG. 5A and FIG. 5B are approximately the same, but the main difference between them is that a fixed USB plug is taken as an example in this embodiment. The USB plug 3 is fixed to the ExpressCard device 1 and the ExpressCard device 1 is connected with the fixed USB-Type-A USB interface 212 of the computer system 2. Hence, the USB plug 3 can be contained in an outer case of the ExpressCard device 1 to reduce occupied space of the USB plug 3 when the USB plug 3 isn't in use.

Additionally, in order to further prevent the ExpressCard interface connector 10 and the USB connector 11 both being connected with the computer system 2 at the same by the users, the USB connector 11 is designed on one longer side of an outer case of the ExpressCard device 1 as shown in FIG. 4, FIG. 5A, and FIG. 5B. When the ExpressCard device 1 is inserted into the ExpressCard interface 211 of the computer system 2, the USB connector 11 cannot be connected with the computer system 2 because the outer case of the ExpressCard device 1 is entirely contained within the computer system 2. In the same way, when the USB connector 11 is connected with the USB plug 3, the ExpressCard interface 211 cannot be inserted to the computer system 2. However, the actual position of the USB connector 11 is not limited by this embodiment.

It follows from what has been said that the ExpressCard device 1 cannot only be connected with the computer system 2 for transmitting data via the ExpressCard interface connector 10, but also can be connected alone with computer system 2 via the USB connector 11 so that a device has different connection interfaces to process USB transmission, and it is convenient to apply the ExpressCard device 1 to different connection interfaces of the computer system 2 without an adapted connector.

Although the present invention has been described with reference to the preferred embodiments thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An ExpressCard device is applied to a computer system, comprising:

a USB connector used to connect with a USB interface provided by the computer system;

an ExpressCard interface connector used to connect with an ExpressCard interface provided by the computer system; and a control unit used to transmit data to the computer system via either the ExpressCard interface connector or the USB connector;

wherein the ExpressCard interface uses a USB standard as an underlying transmission technique so that the ExpressCard interface connector or the USB connector are connected with the control unit via a same USB signal pin.

2. The ExpressCard device with a USB connector as claimed in claim 1, wherein the ExpressCard device is a storage device or a transmission device.

3. The ExpressCard device with a USB connector as claimed in claim 2, wherein the storage device is a memory card reader or a pen drive, and the transmission device is a wireless transceiver for infrared, Bluetooth, Internet, or digital television.

4. The ExpressCard device with a USB connector as claimed in claim 1, wherein the USB connector is further connected with the USB interface via a USB plug.

5. The ExpressCard device with a USB connector as claimed in claim 4, wherein the USB plug is a fixed USB plug or a separable USB plug.

6. The ExpressCard device with a USB connector as claimed in claim 1, wherein the USB interface is a USB-Type-A standard or USB-Type-B standard.

7. The ExpressCard device with a USB connector as claimed in claim 1, wherein the USB connector is used to receive a first voltage transmitted by the USB interface, the ExpressCard interface connector is used to transmit a second voltage provided by the ExpressCard interface, and the first voltage and the second voltage are separately provided to the control unit.

8. The ExpressCard device with a USB connector as claimed in claim 7, wherein wither the USB connector or the ExpressCard interface connector or both the USB connector and the ExpressCard interface connector are further separately connected with a voltage converter to transform the first voltage or the second voltage into the desired operating voltage for the control unit.

9. The ExpressCard device with a USB connector as claimed in claim 1, further comprising a switching unit used to switch the ExpressCard interface connector or the USB connector so that either the ExpressCard interface connector or the USB connector is connected with the computer system at the same time.

10. The ExpressCard device with a USB connector as claimed in claim 9, wherein the switching unit is used to switch the ExpressCard interface connector and the USB connector according to a priority value.

* * * * *